US009469458B2

(12) United States Patent
Padda et al.

(10) Patent No.: US 9,469,458 B2
(45) Date of Patent: Oct. 18, 2016

(54) CLAMSHELL RASPBERRY CONTAINER

(71) Applicant: DRISCOLL STRAWBERRY ASSOCIATES, INC., Watsonville, CA (US)

(72) Inventors: Malkeet Singh Padda, Gilroy, CA (US); Craig R. Snedden, Culver City, CA (US); Gandhi B. Sifuentes, West Covina, CA (US); Cesar Ramirez, Hacienda Heights, CA (US)

(73) Assignee: Driscoll Strawberry Associates, Inc., Watsonville, CA (US)

( * ) Notice: Subject to any disclaimer, the term of this patent is extended or adjusted under 35 U.S.C. 154(b) by 0 days.

(21) Appl. No.: 14/695,488

(22) Filed: Apr. 24, 2015

(65) Prior Publication Data

US 2015/0307257 A1 Oct. 29, 2015

Related U.S. Application Data

(60) Provisional application No. 61/984,331, filed on Apr. 25, 2014.

(51) Int. Cl.
*B65D 81/26* (2006.01)
*B65D 21/02* (2006.01)
(Continued)

(52) U.S. Cl.
CPC ..... *B65D 81/264* (2013.01); *B65D 1/36* (2013.01); *B65D 21/0219* (2013.01);
(Continued)

(58) Field of Classification Search
CPC .. B65D 81/264; B65D 1/36; B65D 21/0219; B65D 21/0223; B65D 25/04; B65D 43/16; B65D 43/162; B65D 43/22; B65D 47/32; B65D 81/263; B65D 85/34; B65D 75/24; B65D 2205/02; B65D 2543/00592
USPC ..... 220/523, 526, 4.01, 4.21, 4.22, 500, 220/501, 507, 553, 555, 556, 810, 834, 220/836; 206/204, 508
See application file for complete search history.

(56) References Cited

U.S. PATENT DOCUMENTS 2,476,181 A 7/1949 Crane et al.
2,894,672 A 7/1959 Bamburg
(Continued)

FOREIGN PATENT DOCUMENTS

GB 2 295 815 A 6/1996
GB 2 339 766 A 2/2000
(Continued)

OTHER PUBLICATIONS

International Search Report and Written Opinion, Application No. PCT/US2015/027487, Oct. 5, 2015.
(Continued)

*Primary Examiner* — Fenn Mathew
*Assistant Examiner* — Elizabeth Volz
(74) *Attorney, Agent, or Firm* — Winston & Strawn LLP

(57) ABSTRACT

A container that includes a tray having a base bottom portion and one or more sidewalls having a volume for holding a product; a lid that is attachable to the tray to protect the product in the tray when attached thereto; and a divider for providing a plurality of compartments with a predetermined volume in the tray, the divider configured, dimensioned and positioned to provide support to the lid, air flow between the compartments and torsional rigidity to the tray. The most preferred container of the invention is a rectangular clamshell container as described herein that includes a spine which is pivotally hinged to the base bottom portion via the lid. This preferred container also includes a plurality of snap locking members for attaching the lid to the tray for retaining contents therein.

17 Claims, 6 Drawing Sheets

(51) Int. Cl.

| | |
|---|---|
| ***B65D 25/04*** | (2006.01) |
| ***B65D 43/16*** | (2006.01) |
| ***B65D 43/22*** | (2006.01) |
| ***B65D 47/32*** | (2006.01) |
| ***B65D 1/36*** | (2006.01) |
| ***B65D 85/34*** | (2006.01) |
| *B65D 75/24* | (2006.01) |

(52) U.S. Cl.

CPC ..... *B65D 21/0223* (2013.01); *B65D 25/04* (2013.01); *B65D 43/16* (2013.01); *B65D 43/162* (2013.01); *B65D 43/22* (2013.01); *B65D 47/32* (2013.01); *B65D 81/263* (2013.01); *B65D 85/34* (2013.01); *B65D 75/24* (2013.01); *B65D 2205/02* (2013.01); *B65D 2543/00592* (2013.01)

(56) References Cited

U.S. PATENT DOCUMENTS

| | | | |
|---|---|---|---|
| 2,910,220 | A | 10/1959 | Hamilton |
| 3,197,058 | A | 7/1965 | Hale |
| 3,203,573 | A | 8/1965 | Rowe |
| 3,334,767 | A | 8/1967 | Cornelius et al. |
| 3,627,170 | A | 12/1971 | Pulliam et al. |
| 3,716,164 | A | 2/1973 | Fennema |
| 3,837,526 | A | 9/1974 | Medendorp |
| 3,935,990 | A | 2/1976 | Crane |
| 3,935,991 | A | 2/1976 | Crane |
| 4,236,541 | A | 12/1980 | Cipriani |
| 4,588,087 | A | 5/1986 | Swingley, Jr. |
| 5,076,459 | A | 12/1991 | DeHart |
| D361,035 | S | 8/1995 | Krupa |
| 5,456,379 | A | 10/1995 | Krupa et al. |
| D363,879 | S | 11/1995 | Krupa et al. |
| D372,171 | S | 7/1996 | Romero et al. |
| D378,192 | S | 2/1997 | Krupa et al. |
| 5,860,528 | A | 1/1999 | Emery |
| 5,947,321 | A | 9/1999 | Vadney |
| 5,947,336 | A | 9/1999 | Thompson |
| 6,047,819 | A | 4/2000 | Brost et al. |
| 6,257,401 | B1 | 7/2001 | Mangla et al. |
| 6,273,291 | B1 | 8/2001 | Conti |
| 6,669,082 | B1 | 12/2003 | Meyer |
| 6,685,022 | B2 | 2/2004 | Sullivan |
| D512,633 | S | 12/2005 | Sambrailo et al. |
| 2001/0002268 | A1 | 5/2001 | Hanson et al. |
| 2003/0136699 | A1 | 7/2003 | McNeeley et al. |
| 2003/0152670 | A1 | 8/2003 | Shih |
| 2004/0026430 | A1 | 2/2004 | Baker et al. |
| 2005/0145529 | A1 | 7/2005 | Andrews et al. |
| 2005/0247709 | A1 | 11/2005 | Atkins et al. |
| 2006/0249516 | A1 | 11/2006 | Giumarra |
| 2007/0056980 | A1 | 3/2007 | Sambrailo |
| 2008/0121550 | A1* | 5/2008 | Anderson ..... B65D 1/36 206/562 |
| 2008/0199577 | A1* | 8/2008 | Jensen ..... A47J 47/10 426/393 |
| 2009/0014348 | A1 | 1/2009 | Strange et al. |
| 2009/0223966 | A1* | 9/2009 | Kidd ..... B65D 75/22 220/324 |
| 2011/0094918 | A1* | 4/2011 | Hernandez ..... B65D 21/0223 206/521.15 |
| 2013/0004625 | A1 | 1/2013 | Brummer et al. |

FOREIGN PATENT DOCUMENTS

| | | | |
|---|---|---|---|
| KR | 2012-0078320 | A | 7/2012 |
| WO | 97/17264 | A1 | 5/1997 |

OTHER PUBLICATIONS

Partial International Search Report, Application No. PCT/US2015/027487, Jul. 7, 2015.

* cited by examiner

CLAMSHELL RASPBERRY CONTAINER

CROSS-REFERENCE TO RELATED APPLICATIONS

This application claims the benefit of U.S. provisional application 61/984,331 filed Apr. 25, 2014, the entire content of which is expressly incorporated herein by reference thereto.

BACKGROUND OF THE INVENTION

1. Field of the Invention

The present invention relates to a container apparatus. In particular, the present invention specifically teaches a clam-shell container for use in containing, storing, displaying and shipping produce items. The novel structural features of the clam-shell container advantageously enables plurality of produce items such as various berries, grapes or other fruit or produce items to be shipped while protecting the container contents during shipping and transport, while at the same time keeping the contents cool and fresh until it reaches the consumer due to an increased amount of air-flow circulating inside the container made possible by its unique structural features.

2. Background—Description of the Prior Art

Fresh produce contains many essential nutrients and vitamins that are needed for maintaining good health. The time necessary for harvesting, storing and transporting the produce to the actual costumer is an essential factor that must be taken into account. Some produce items such as berries, grapes and similar items require a relatively careful handling procedure. This is especially true because they contain pulp and juice which can be lost with all the nutrients during transportation due to damage if not handled and transported carefully.

Thus the weight and pressure that the produce must withstand should be limited or controlled in order to avoid potential damage. Oftentimes during transportation, containers may slide and during an impact, poorly designed and weekly structured containers that are stacked on one another may either fall down and spilling their contents, or the juices of the produce may be lost due to the damage as mentioned above. Also, container lids can deflected into the container to cause compression or damage to container contents. And the movement of the contents within the container can cause additional damage.

A number of prior art documents exist that are directed to the shipping of berries and other produce as well as to other items.

U.S. Pat. No. 2,894,672 to Bamburg teaches fiberboard boxes folded from a single blank of sheet material adapted to receive and carry small containers of perishable berries. Bamburg also discloses containers with smooth exterior surface that provide the ability with stacking locks and tabs which enable them to be stacked on top of each other.

U.S. Pat. Nos. 2,476,181 and 2,910,220 issued to Crane and Hamilton respectively relate to open produce trays or containers formed from a cardboard blank having divided compartments with a central divider that can be stacked for storage or shipping, further comprising openings and holes on the bottom for providing a means of ventilation.

U.S. Pat. No. 3,203,573 to Rowe teaches an integrally formed stacking container for foods of uniform thickness material providing multiple compartments of uniform elevation bottoms and varying height upstanding walls. The walls making up the container are of inverted V cross-section to permit nesting of identical containers one above the other. The uniform elevation bottoms of the compartments have drainage openings to keep the contents free of excessive collecting moisture.

U.S. Pat. No. 3,334,767 to Cornelius teaches a one-piece rectangular bottle carrier having a reinforced bottom wall, side walls and end walls, which are sub-divided into four equal compartments by related longitudinal and transverse partitions.

U.S. Pat. No. 3,627,170 to Pulliam discloses a plastic food container having a straight walled top-portion and a tapered bottom portion. The bottom portion terminates in a peripheral lip surrounding a concave bottom and the container has a removable top, which is provided with a peripheral locking flange having an enlarged edge which snaps over an enlarged rim on the container. Ribs are provided to space the containers in a stack to allow for air circulation.

U.S. Pat. No. 3,716,164 to Fennema discloses a rectangular berry basket and cover comprising a plastic lattice-work berry basket having a novel locking arrangement for the cover and the berry basket. The plastic lattice-work of the berry basket provides open air ventilation to the berry contents.

U.S. Pat. No. 3,837,526 to Medendorp discloses a berry container which is enclosed by a one piece cover differential pressure formed of very thin thermoplastic material suitable for packaging, protecting and displaying the berries. The cover is cup-shaped and the interior of each side is formed with a narrow shoulder which seats on the upper lip of the container to index the cover relative to the container.

U.S. Pat. Nos. 3,935,990 and 3,935,991 each to Crane disclose reinforced paperboard produce containers having reinforcing end frames of molded thermosetting plastic or other suitably rigid construction secured to the outer sides of the end walls of a paperboard container body with edge flanges on the frames projecting inwardly over the upper end wall edges and under the bottom wall of the body to provide upper and lower stacking edges. The reinforced containers are of sufficient strength, and interfit in such manner, that a number of them may be stacked with ample strength and stability in vertical columns. The containers have hinged lids or cover panels formed with tabs which engage with formations on the end frames to alternatively releasably lock the lids in closed, or open, folded away positions.

U.S. Pat. No. 4,236,541 to Cipriani discloses an apparatus for washing and drying vegetables and fruit. The apparatus includes a closed prism-shaped container in which is housed a rotatable cylinder container provided with a plurality of passage holes. Vegetables and fruits are introduced into the container and subjected to water injectors for washing the produce which is then dried by centrifugal force in the rotatable cylinder container.

U.S. Pat. No. 4,588,087 to Swingley, Jr. relates to a molded plastic fruit basket constructed to provide ventilation without uncontrolled drippage into a lower container of bottom openings surrounded by raised rims, side openings that terminate above the bottom, and end weep holes to direct drippage away from a lower stacked container.

U.S. Pat. No. 5,076,459 to DeHart is concerned with a berry basket and cover which includes a dome-shaped basket cover comprised of clear plastic having a straight skirt depending from a dome portion and corners in the skirt having detents which releasably mate and lock onto corners of a rectangular basket. In a preferred embodiment, the basket cover is provided with vents which are angled with respect to a flat top of the cover and its sides while the basket includes bottom vents and side corner vents.

U.S. Pat. Nos. 5,456,379, D 361,035, D 363,879 and D 378,192, each to Krupa, disclose a berry container comprising a reusable, rectangular-shaped tray for securely containing both small and large produce. Ventilating means effectively permits the transfer of fluids between the interior and exterior of the tray which can be combined with a hinged cover to form a container. The container also includes ribs for providing structural support where the ribs include slits that provide an additional ventilation source.

U.S. Pat. No. 5,860,528 to Emery teaches a molded container with a detachable hinged cover. The cover has two side walls and a top wall which may have various perforations to expose to view the contents of the container. A first sidewall at the hinge side of the cover has a least two downwardly and outwardly extensions thereof, located to correspond with related hinge parts of the tray. A second and opposite side wall optionally has locking parts, which cooperate with related locking parts on the tray.

U.S. Pat. No. 5,947,336 to Thompson generally teaches a cylindrical container with a removable top for covering a central storage area which can hold a dry baby formula or other dry food commodity. The mid-section of the cylindrical container includes a tapered funnel terminating in an opening. A rotatable cylinder is operably carried on the funnel having a pre-measured receptacle or cavity co-extensive with the funnel opening for collecting a quantity of the dry food product. Upon rotation of the cylinder, the receptacle carries the product from the funnel for external dispensing into a utility container for usage.

U.S. Pat. No. 6,047,819 issued to Borst discloses a clam-shell container that is designed for holding graphic displays to illustrate what is provided by or in the container.

U.S. Pat. No. 6,257,401 to Mangla discloses a thermoplastic container for food or other articles having a rectangular bottom tray, a removable top and a pair of integral handle segments. A plurality of wells formed in the bottom tray retain fluid via capillary action or surface tension forces prevent fluid from flowing out if the base of the bottom tray is tilted or tuned upside-down. A plurality of cover venting notches and base venting notches and apertures formed in the sidewalls of the cover provide ventilation to the container.

U.S. Pat. No. 6,273,291 to Conti discloses containers with replaceable lids for holding fresh fruit or other food that is to be quick frozen. The containers and lids are stackable one upon the other so that flow passages are provided between the lid of one container and a bottom of a like container resting on that lid to permit the flow of a gaseous freezing medium there between.

U.S. Pat. No. D 372,171 issued to Romero discloses a right circular cylinder container with a converging bottom opening that is adjustable via a mechanical knob to dispense the contents of the container.

U.S. Pat. No. 6,669,082 to Meyer teaches a compression supporting divider set having an upper edge and a spaced apart lower edge, the upper and lower edges being connected by a side edge forming an end of the divider. A cut line extends from one of the upper and lower edges to an interior point of the divider spaced from the upper and lower edges and from the side edges.

U.S. Pat. No. 6,685,022 to Sullivan teaches a single compartment clam-shell container made of cardboard or chipboard.

U.S. Patent Publication No. US 2003/0152670 to Shih pertains to a food container capable of increasing the effect of air permeability and has a plane jointed side located between a main body and a top cover of an unitarily molded container, a plurality of permeability holes disposed on the abovementioned plane for increasing air permeability of the entire container, accelerating the cold storage and ripening process of the fruit so as to enhance the efficiency and save the laboring time, and furthermore a bottom portion of the container main body is disposed with a plurality of L-shaped slot holes for draining the water.

U.S. Patent Publication No. US 2003/0136699 to McNeeley discloses nestable and stackable food storage containers having a base with a bottom panel. The bottom panel has an upper side, a lower side and a base perimeter. A removable lid has a top panel with a top side, bottom side and a lid perimeter. The container and lid exhibit a nesting structure which facilitates the stacking of the containers.

U.S. Patent Publication No. 2006/0249516 to Giumarra teaches an elongated produce container which is hollow and includes a bottom plane for closing the lower end of the elongated container. Moreover Giumarra relates to a plurality of apertures configured on the bottom plane to provide ventilation and drainage of the produce fluid from the elongated container.

U.S. Patent Publication No. 2007/0056980 to Sambrailo discloses containers having a lid connected to a body with a hinge and securable using latches. The closed lid defines at least two horizontal ventilation slots between the lid and body and at opposite ends of the container.

While the prior art mentioned hereinabove in general teaches multifunctional molded containers or support trays for shipping or transporting of various produce or other items, it does not resolve the problems of the prior art with respect to the protection of produce contents during shipping and transport, in particular, for larger size containers. Thus, there is a need in the art for a new and improved container that can be used in containing, shipping, transporting and storing in a cooled environment produce items that display a notable vulnerability and fragility and a great potential of easily undergoing damage. This is particularly sought by produce exporting facilities, that suffer tremendous financial loss due to poorly designed containers, consequently resulting in a damage to the produce items during transportation and storage. The present invention now satisfies this need by providing such improved containers.

SUMMARY OF THE INVENTION

The invention relates to a container comprising a tray comprising a base bottom portion and one or more sidewalls having a volume for holding a product; a lid that is attachable to the tray to protect the product in the tray when attached thereto; and a divider for providing a plurality of compartments with a predetermined volume in the tray, the divider configured, dimensioned and positioned to include a central section to support the lid; shoulder portions adjacent the central section that allow air flow between the compartments over the divider; and end portions adjacent the shoulder portions and connected to the sidewall(s) to provide torsional rigidity to the tray.

Advantageously, the central section of the divider represents about ¼ to ½ of the overall length of the divider and contacts the lid when the lid is closed over the compartments.

The first and second shoulders are spaced from and do not contact the lid when the lid is closed over the compartments to allow airflow between the compartments, and the end portions are configured as first and second arcuate tray strengthening portions that each extend downwardly from the adjacent shoulder portions towards the sidewall(s). The first and second shoulders advantageously constitutes about ¼ and ⅓ of the overall length of the divider, while the first and second arcuate tray strengthening portions also constitute about 1/25 to 1/10 of the overall length of the divider.

The divider may include first and second walls joined by an upper portion in which the upper portion includes the central section, the first and second shoulder portions and the first and second arcuate tray strengthening portions. This facilitates stacking of the filled containers.

The most preferred container of the invention is a rectangular clamshell container as described herein that includes a spine which is pivotally hinged to the base bottom portion via the lid. The sidewalls of the container are curved to prevent bruising of container contents. The container may also include a plurality of snap locking members for attaching the lid to the tray for retaining contents within the container.

Generally, the container further comprises a plurality of air vents located near the periphery of the lid, the periphery of the base bottom, or both wherein the air vents also allow evaporation or draining of water or moisture present inside the container. Each compartment preferably includes a plurality of air vents in a lower portion of the sidewall(s) and indentations extending into the compartment between adjacent air vents to minimize contact of container contents with the air vents. In addition, the container further comprises air flow openings provided above the sidewalls of the tray and below the lid when the lid is attached to the tray to allow air flow into the container for contact with the contents.

The lid preferably includes a recess configured and dimensioned to receive the base bottom of another container to allow stacking of one closed container upon another. Also, a soaking pad may be provided in each compartment to absorb moisture from container contents. The container of the invention is typically made of molded plastic.

DETAILED DESCRIPTION OF THE PREFERRED EMBODIMENT

Figure 1:
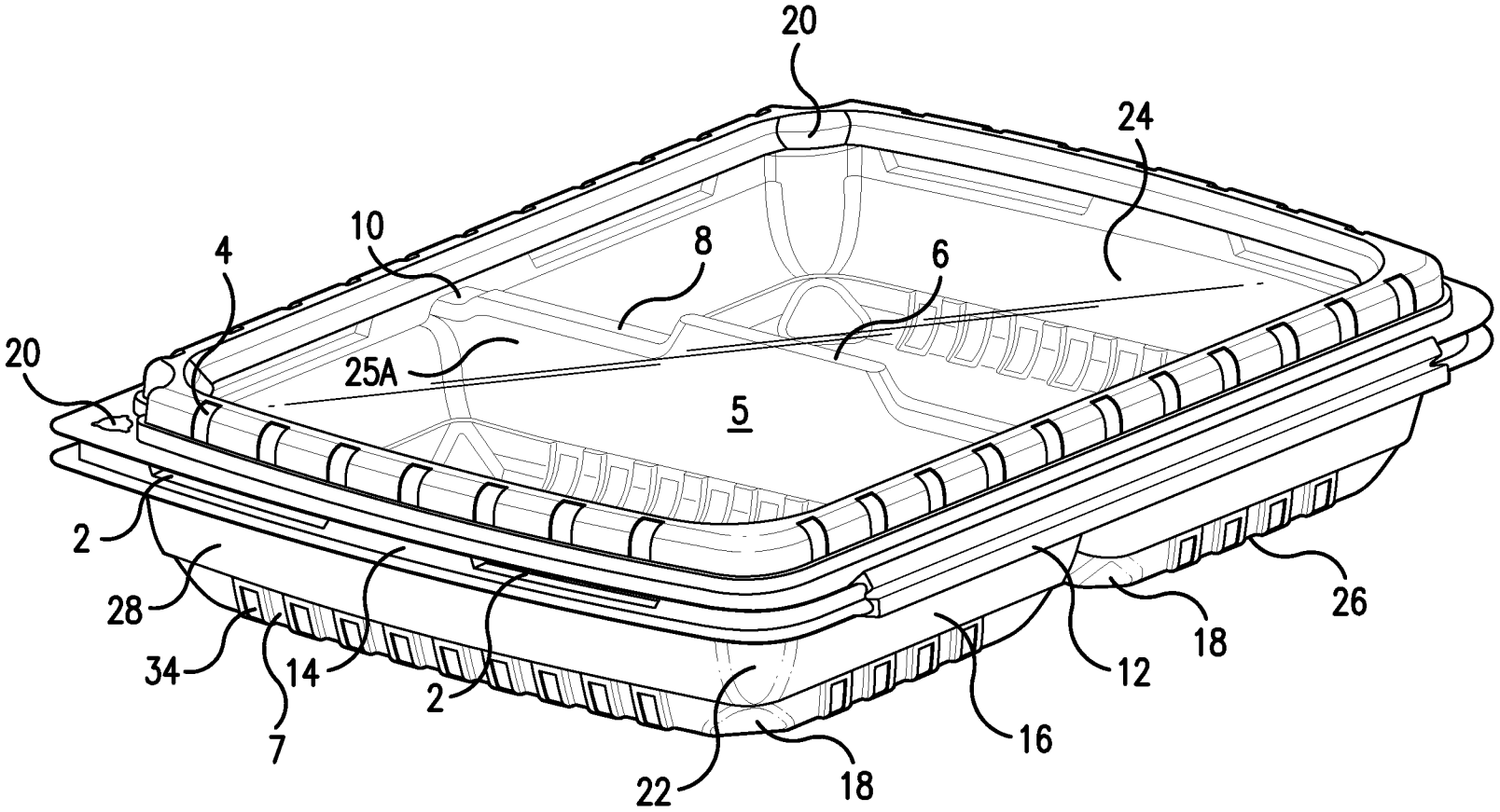
FIG. 1 is a top-plan perspective view of a stackable closed produce clam-shell container according to a preferred embodiment of the invention.

In view of the foregoing and the description provided herein, the disadvantages inherent in the prior art comprising containers for carrying and shipping produce are overcome, as the present invention provides a novel clamshell container that has several advantages which are as follows: to transport produce items such as berries, grapes, and other fruits or produce before they reaches the groceries, supermarkets and the consumers in an undamaged manner due to the unique central dividing structural feature, which ensures that the produce items have only a minimum impact on each other during shipping or transportation, thereby preserving the integrity and nutritional value of the produce items.

The invention specifically relates to a clamshell raspberry container that offers the advantage and ability of transporting raspberries or other soft, fragile and vulnerable produce items that can easily undergo damage upon shipping, transportation and storage, while at the same time keeping the produce cool and fresh during transportation conferred through its unique and novel architectural structure. The clamshell container comprises an outside top lid, a hinged spine configured to connect to a base bottom portion that has two equally sized and separated compartments, a plurality of air flow windows above the front and side-walls advantageously allowing increased amount of air mass flow and circulation inside the container and thereby maintaining the shipped produce items cool and fresh before reaching the customer. In particular, the clamshell container has a central divider comprising a top support, which separates the container into two equally sized compartments and that further allows the top lid to make proper contacts thereto effectuating a firm sealing effect. The top lid also has a stacking frame which allows multiple containers to be easily and securely stacked on top of each other. In addition, the central divider comprises a pair of shoulders and arcuate tray strengthening portions that extend from the top support and that provide extensive torsional rigidity. The central divider further allows the creation of perforated side air vents surrounding the complete edge of the top lid and bottom of the divided compartments of the container to efficiently allow evaporation and drainage of any unwanted condensed water and moisture, which would otherwise accumulate inside the container and inadvertently cause rottenness of the produce. Thus a multifunctional container is thereby provided, which exhibits exceptional torsional rigidity, as well as the capability of transporting and storing the produce items cooled and in a secure and undamaged manner.

In accordance with the preferred embodiment disclosed in the appended figures, the invention specifically pertains to a clamshell container. This container comprises two separated compartments, a plurality of air flow windows 2 allowing increased air flow and circulation inside the container and thereby maintaining the transported produce items cool and fresh before reaching the customer. Especially, the container has a central divider comprising a top support 6, a pair of shoulders 8 and arcuate tray strengthening portions 10 that extend from the top support 6 providing extensive torsional rigidity, and further allow the creation of perforated side air vents 4 on the edge surrounding the top lid 24 and base bottom portion 26 of the container, to allow evaporation or drainage of any condensed water and moisture, which would otherwise accumulate inside the container and which can cause spoilage of the contents.

Moreover, the plurality of the perforated side air vents surrounding the edge of the top lid 24 and the base bottom portion 26 make it possible to increase the cool air-mass that travels into the box conferring an efficient temperature lowering cooling-mechanism disposed to the produce, whereby the consumer can rest assure that the produce items are transported and kept as fresh as possible. The air vents surrounding the base bottom portion 26, as well as the top lid 4, ensure that condensation and moisture is not built up inside the clam-shell container and any produced water can freely drain through the slots of the side air vents on the base bottom portion 26. By selecting the final design and construction of the produce clamshell container, a pleasing design will be provided.

With reference to the drawings in FIGS. 1 through 8 in general, the novel clamshell container 24 will now be described in greater detail.

The clamshell container as illustrated in FIGS. 1-8 in the preferred embodiment is constructed from a rectangular molded plastic, which is able to contain, for example, a total net weight of raspberries of 18 oz. with the preferred dimensions disclosed herein. The container comprises a top lid providing a stacking frame 24, which is hinged pivotally through a spine 12 to the base of the bottom portion of the container 26, separating into two equally dimensioned and sized separated compartments. Thus, the top lid 24 cooperates, and is in full contact with the base bottom portion 26 through the spine 12. The longitudinal length of the top lid 24 is straight, whereas the width of the top lid 24 is inwardly curved.

As best seen in FIG. 1, the container comprises a first plurality of perforated side air vents 4 surrounding the edge of the top lid 24 and a second plurality of perforated side air vents 34 surrounding the base bottom portion 26, wherein all of the air vents are made up by a plurality of slots or apertures configured to have an overall elongated oval or rectangular shape. The vents 4 allow cooling air to enter the container while vents 34 serve as a main purpose of effectively removing any condensed or otherwise accumulated water inside the container through evaporation during transportation before the packaged product reaches the customer. The lid vents 4 are positioned in an upper portion of the lid so that so that they do not contact the container contents where they can cause slicing or cutting, in particular when berries are the container contents.

Figure 2:
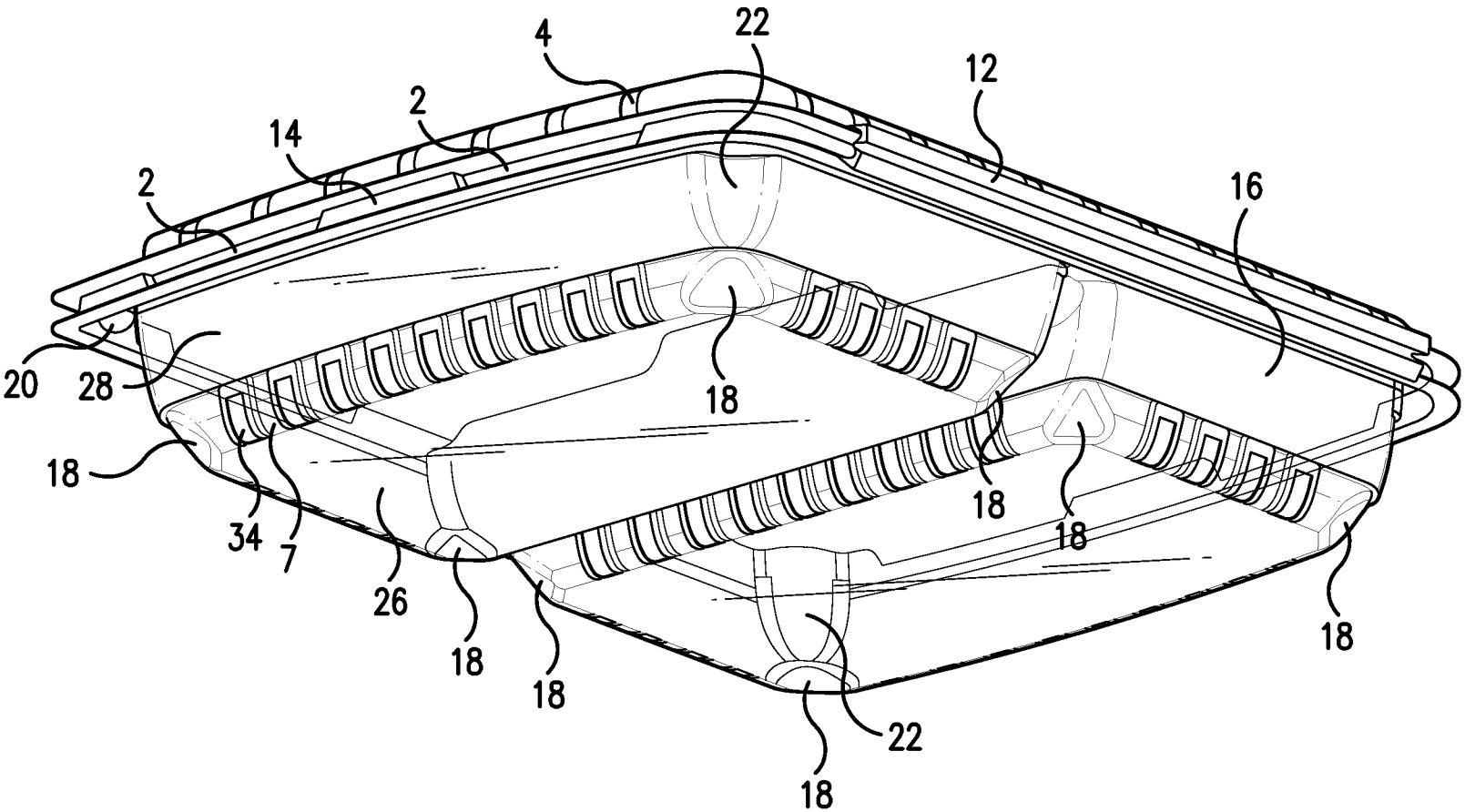
FIG. 2 is a bottom-plan perspective view of the clam-shell container of FIG. 1.
Figure 3:
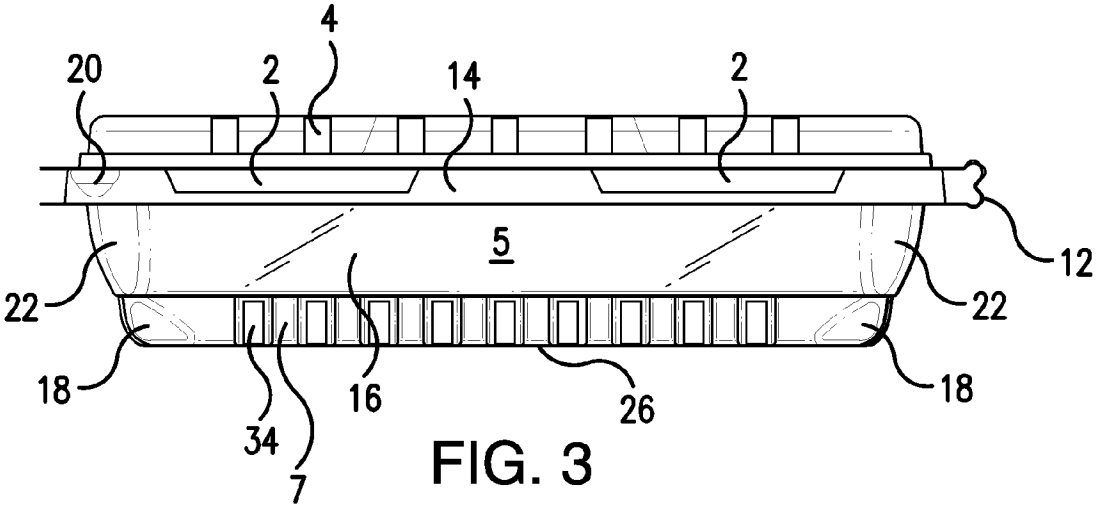
FIG. 3 is a right-side elevational view of the clam-shell container of FIG. 1.
Figure 4:
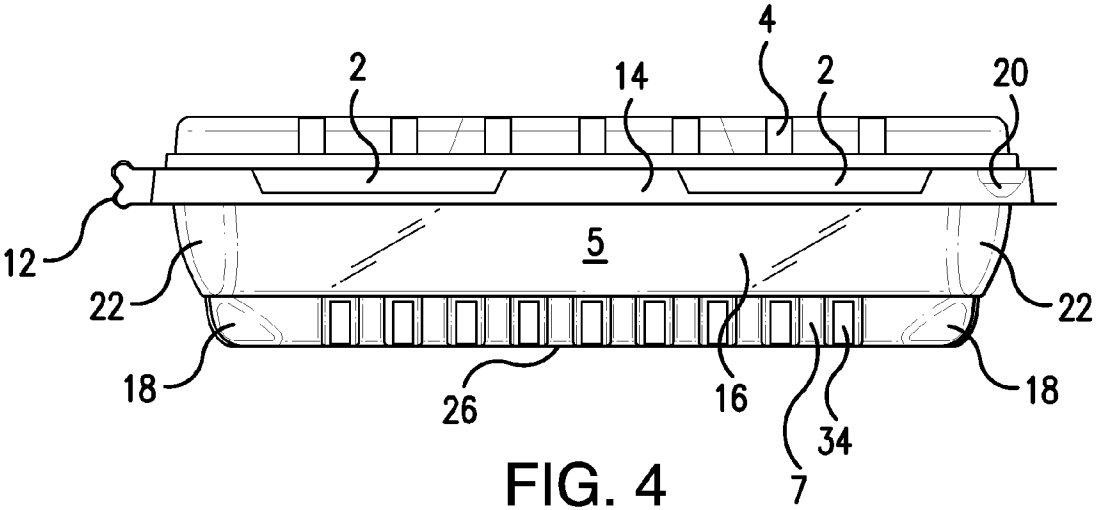
FIG. 4 is a left-side elevational view of the clam-shell container of FIG. 1.

Similarly, the perforated side air vents 34 on the base bottom portion 26 as depicted in FIGS. 1 and 2 are provided on outwardly curved side portions that extend away from the container contents. These lower vents 34 may be configured to be the same size as the outwardly curved side portions or they can also be configured as "windows" in such portions as shown. These lower vents 34 are positioned near the bottom of the container so that they also efficiently serve as an extensive drainage means of any accumulated water. Thus, it will become immediately evident to the reader, that such a construction comprising perforated slots will greatly enhance the stability and shelf-life of the produce items, as the evaporation, or drainage of condensed water will minimize the growth of microorganisms or the like on the produce and will thereby greatly increase its stability. The specific size and shape of these air vents are not critical and can be round, polygonal, oval, or combinations thereof as desired. In addition, for certain containers according to the invention, these air vents are optional.

As the lower air vents 34 are cut into the plastic material along the entire periphery of the lower sidewalls of the container, they provide a relatively sharp outline that may cause cutting or lacerating of the berries that come into contact with them during transport or shipping. For this reason, inwardly curved indentations 7 are provided between adjacent air vents, which extend slightly into the inner part of the container and serve to push the container contents away from the vent holes. These indentations are useful in preventing the berries from contacting or being wedged into the air vents 34 where they could be damaged due to lacerations or cuts during transport of the filled containers. The relative sizes of the vents and indentations are not critical and the indentations can even be smaller in area than the vents to still obtain the benefits of laceration prevention. Of course, they can also be the same size or the indentations can even be larger than the vents provided that the vents are sized sufficiently large to allow cooling air to enter the container and to allow accumulated water or liquid to drain.

The creation of the side air vents 4, 34 are included due to the presence of a central divider which separates the container into two equally sized compartments as described herein. The central divider 5 comprises a top support 6 which is configured to contact and support the lid to prevent deflection of the lid into the volume of the container where it could cause compression and damage to the contents therein. Preferably, the central divider 5 is formed from two sidewalls which terminate at the top of the divider to form the top support, shoulders and arcuate portions. The height of the top support 6 is constructed to properly contact the top lid 24 upon closing the container. The top support 6 represents between ¼ to ½ and preferably about ⅔ to ⅓ of the overall length of the central divider in order to provide sufficient support of the lid 24 when closed over the compartments. Also, the height of the top support of the divider is selected to hold the lid up to avoid damage to produce or berries therein during transport.

The top support 6 also allows multiple containers to be easily and securely stacked on top of each other when the container is in an open configuration, and thus, when the container is not closed and in use. In addition, the stacking frame of the top lid 24 provides a similar functionality, but this time when the top lid 24 is closed and the container is in use with the product inside it.

Extending from the top support longitudinally is a pair of shoulders 8 which have a lower height than the top support such that when the lid is closed on the container, the shoulders 8 provide an open area through which air flow is allowed. This enables cooling air to flow into the container for cooling of the contents. Cooling air can also enter into the container through the air vents 4. This facilitates cooling of the product during shipping and transport.

Further extending from the shoulders 8 is the pair of curved arcuate tray strengthening portions 10 as best viewed in FIG. 1. Thanks to the location, position and configuration of these arcuate portions 10, significantly increased torsional rigidity is thereby provided, such that the container can be bent, twisted or otherwise subject to flexing forces without permanently deforming the container. This feature assists in preventing collapse or twisting of the container, which could damage the container contents.

Besides providing extensive strength and rigidity to the container, the central divider 5 of the container has another purpose of conveniently keeping the produce items separated and further from bouncing on each other, which could otherwise result in a significant amount of damage to the produce and thereby also waste and loss of the pulp, juice and of all the nutritional value during transportation, shipment or storage. Each shoulder 8 constitutes of about ¼ to ⅓ of the total length of the compartment divider, and in the most preferred embodiment, represent about ⅔ to ⅓ of that length, while each tray strengthening portion constitutes of about 1/25 to 1/10 and preferably around 1/20 to 1/12 of the total length of the compartment divider.

The central divider 5 is thus attached to the sidewalls of the container by the arcuate tray strengthening portions 10 which then terminate at the relatively linear shoulders 8, which then extend to the top support 6. The arcuate portions 10 can be concave or convex in configuration depending upon the overall size of the container. They are generally sized so that the opening between the arcuate portions and the lid are smaller than the size of the berries or other products that are to be placed in the container. The width of the arcuate portions also is minimized to avoid berries sticking between those portions and the lid at both ends of divider. The extent of curvature is not critical and can be determined by routine testing, but it has been found that some curvature is helpful to strengthen the connection between the divider and sidewall of the container. The arcuate portions are positioned to be below the height of the shoulders and the top of the sidewalls of the container.

The transition between the top support and shoulders is not critical. While it can be vertical, it is better to have a gradual linear or arcuate slope. The drawings show a gradual linear slope which is most preferred. The same applies to the transition between the shoulders and tray strengthening portions.

The shoulders 8 are shown as being horizontal but alternatively can be angled or inclined compared to the top support 6. The top support 6 has an upper surface that is configured to match and conform to the lower surface of the lid 24. Generally, the lid lower surface will be relatively flat and the upper surface of the top support will be horizontal to provide optimum support of the lid.

Moreover, the container may further comprises a plurality of air flow windows 2, which are situated above the sidewalls 28, as well as above the smooth wall curved body 16 and adjacent the edge support bars 14 as best demonstrated in FIGS. 1, 2 and 3-5. The mere presence of these air flow windows 2 allows a flow of continuous cool air-mass, which thereby provides an efficient cooling effect of the produce item. In addition, for certain containers according to the invention, these air flow windows are optional.

In addition, the cool air mass can conveniently flow in between the two compartments as well, due to the lower height of the shoulders 8 and curved arcuate tray strengthening portions 10, which do not make any contact with the top lid 24 as the top support 6 does when the top lid 24 is in a closed configuration as shown in FIG. 1. This ensures that the produce is maintained at a low enough temperature during shipping, transportation and storage at all times, in order to ensure maximum freshness and suppression and avoidance of potential spoilage of the container contents before it reaches the consumer.

Figure 5:
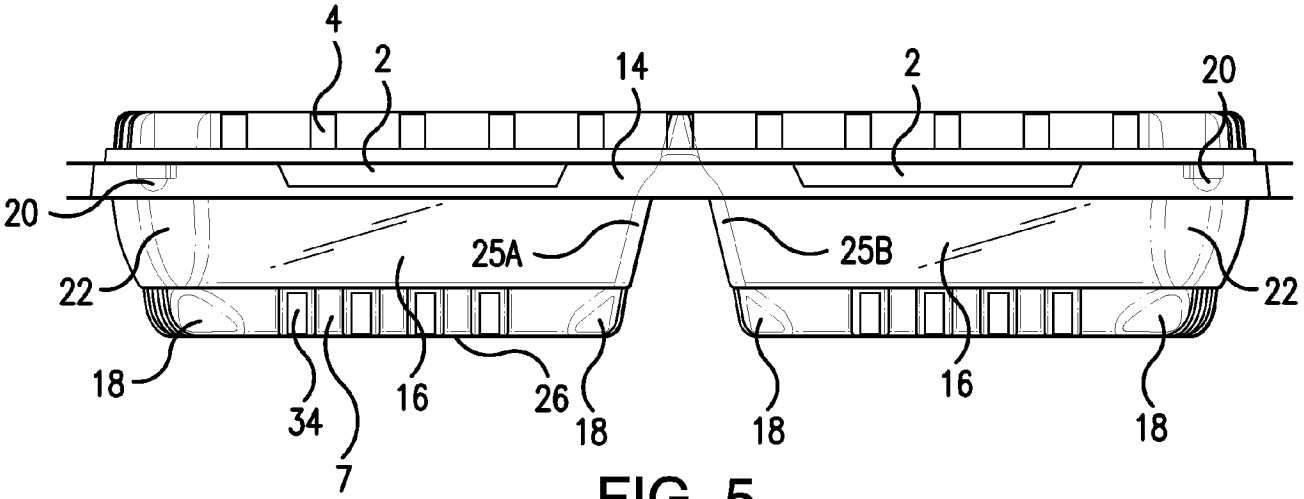
FIG. 5 is a front elevational view of the clam-shell container of FIG. 1.
Figure 6:
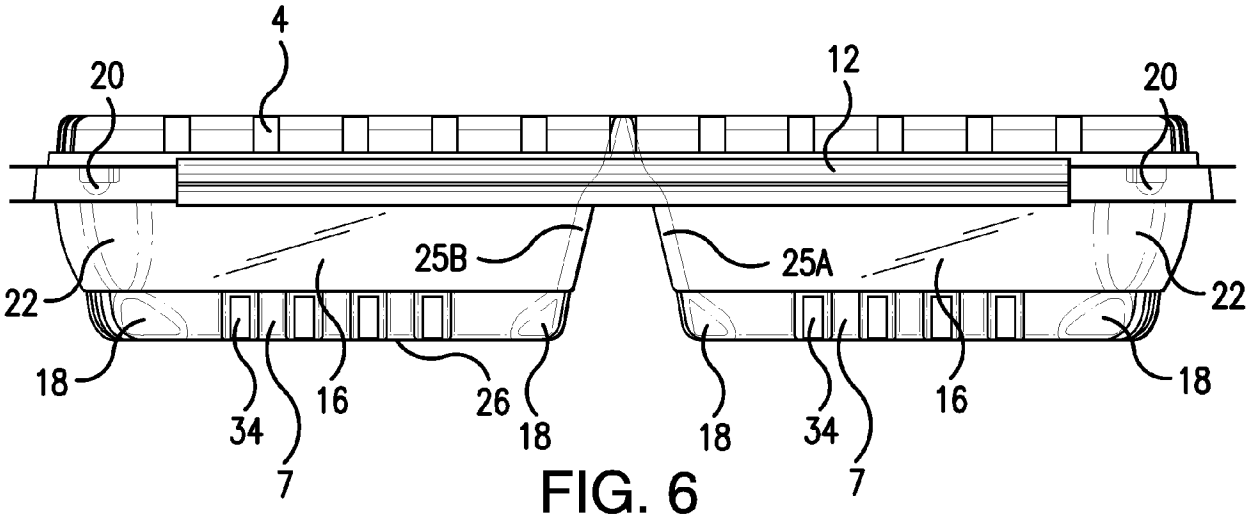
FIG. 6 is a rear elevational view of the clam-shell container of FIG. 1.
Figure 7:
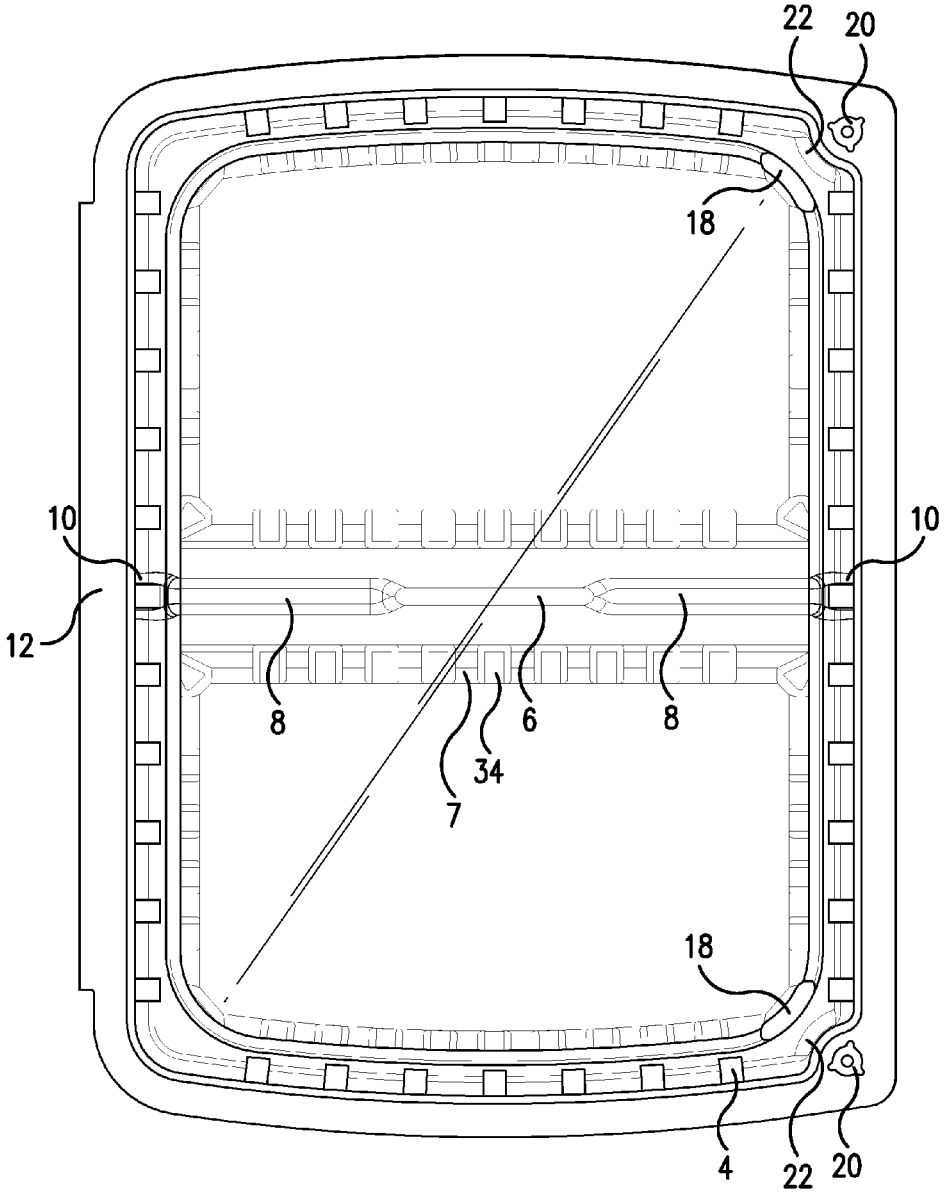
FIG. 7 is a top-plan view of the clam-shell container of FIG. 1.
Figure 8:
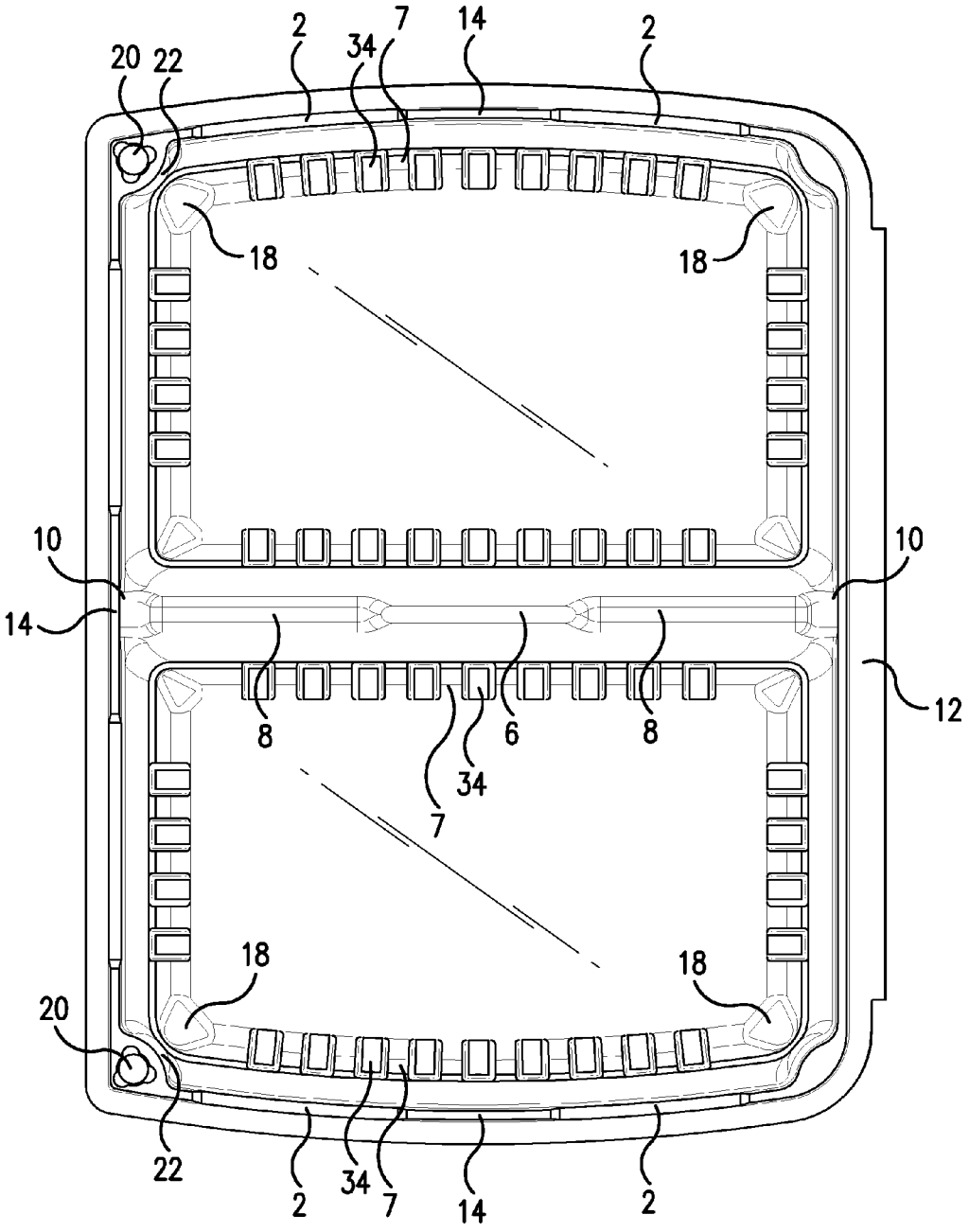
FIG. 8 is a bottom-plan view of the clam-shell container of FIG. 1.

Moreover, as the lid is attached to the compartments by a resilient spine 12, the container preferably comprises two corners with snaps 20 as seen in FIGS. 1 and 5-6 that provide effective strong locking means when closing the top lid 24, which will maintain the contents inside the container, e.g., to keep the produce items in a static stationary manner and prevent them from rolling, sliding or otherwise bouncing into one another conferred by impact.

By way of example of a most preferred 18 oz. raspberry container, which should certainly not be interpreted as a limitation in any way, each air flow window 2 creates vertical air vent openings of about 0.25 inches in the largest width and the edge support bar 14 measures at least about 1.9 inches in length. The longitudinal length dimensions of the top lid portion 24 comprises at least about 9.44 inches, whereas the width is at least about 7.25 inches. Thus when the container is in an open configuration, the container measures at least about 14.50 inches in width in total. The approximate height of the closed container is at least about 1.79 inches, whereas the stacking height of two containers is at least about 3.44 inches. These specific dimensions can be varied depending upon the specific products to be conveyed in the container, e.g., raspberries, strawberries, blueberries, blackberries, etc.

Generally, the present containers are designed to hold larger weights and volumes of berries or similar items. Thus, the container is intended to hold 16 oz. or more of such products, with the container having a volume of about 125 to 500 cubic inches in two or more compartments as desired. A skilled artisan can readily design optimum configurations for other products based on the disclosure provided herein.

Moreover, each of the two compartments comprises four bottom corners 18 providing an angled tilting effect, and similarly, the container contains four curved side corners 22 that are angled relative to the longitudinal length and the width of the compartments as best illustrated in FIGS. 2-6.

Once again, these features make it possible to provide an optimal and efficient drainage potential of any accumulated condensation or liquid due to their curved and angled feature.

Furthermore, it is to be understood that the invention is not limited in its application to the details of construction and to the arrangements of the components set forth in the following description or illustrated in the appended drawings. The invention is capable of other embodiments and of being practiced and carried out in different ways. Also, it is to be understood that the terminology used herein is for the purpose of description and should not be regarded as a limiting factor.

As such, those skilled in the art will appreciate that the conception upon which this disclosure is based, may also be utilized as a basis for designing other structures for carrying out the several purposes of the present invention. It is therefore equally important that the claims be regarded as including such equivalent constructions insofar as they do not depart from the spirit and scope of the present invention.

Design Aspects of the Invention

There are various possibilities and variations with regard to the dimensions, configurations, as well as materials used to construct the clamshell container.

As described hereinabove in the preferred embodiment, all the individual entities making up the container is constructed from molded plastic. Other materials can be used that provides the unique desired rigid bending and twisting feature of the container without breakage. The preferred plastic is polyethylene terephthalate, either virgin or recycled from bottles or combinations thereof, but any other moldable or thermoformable plastics may instead be used again depending upon the size and shape of the container. Typically, the plastic is clear to allow for better viewing of the container contents, but if desired, the plastic may be colored to impart an additional differentiating feature to the container.

In the preferred embodiment, the container has been described as being made in a rectangular geometry, but can similarly be fashioned into any suitable geometric shape including but not limited to a cylindrical, circular, oval, pentagonal, hexagonal, octagonal, or triangular-shaped container.

The top lid 24 includes vents 4 which in combination with air flow windows 2 provides a distinctive appearance that allows an observer to easily ascertain that cooling air can enter into the container. Also, the base bottom portion 26 comprises perforated side air vents 34 for promoting ventilation through and drainage of for example berry juice or fluid or condensation build-up from or cleansing water through the elongated container. The slots of the perforated side air vents are formed of rectangular or oval-like shape, but can conveniently be formed and assume any other desired shape or pattern consistent with the requirements of providing the maximum ventilation effect for the produce as well as drainage capability. Also, as noted above, the air vents 4, 34 and air flow windows 2 are optional, e.g., for containers used for contents that do not require cooling.

Each of the two compartments comprises four bottom 18 corners providing an angled tilting effect, and similarly, the container contains four curved side corners 22 that are also angled relative to the longitudinal length and the width of the compartments. These are preferably constructed angled in order to achieve maximum drainage potential of condensed liquid. Skilled artisans are aware of other designs that can be used to provide stacking of the containers. In addition, the container may also very well have more corners with snaps that provide the locking function than just two as demonstrated in the preferred embodiment as shown in FIG. 1.

Accordingly, the design elements shown in the drawings which are described herein as being optional can be shown in phantom for these alternative embodiments.

Moreover, the skilled artisan will also readily understand and appreciate that the mentioned sizes of the dimensions of the individual entities are not solely limited to these values, as they are merely shown as examples for the preferred embodiment.

Thus, the container can also have longer or shorter longitudinal lengths, as well as longer or shorter widths, and can similarly be composed of more compartments as desired by the consumer, as long as the key structural features and architectural units are preserved, and can similarly be heavier or lighter than 18 oz. The key features being the ability to bend, twist or subject the container to any other external force without conferring any breakage of the container.

Besides providing torsional flexibility and rigidity, these novel features made up by the central compartment divider comprising the top support 6, the shoulders 8 and the arcuate tray strengthening portions 10 provides a different visual appearance from other containers while allowing the observer to ascertain the separate compartments for transporting the product items neatly and stably and to also determine whether the contents have suffered from any substantial damage during transportation or storage. Moreover, they also ensure that when the consumer opens up the container, the consumer will not drop the produce because of damage of the container due to a poor or weak strength or design of the container.

Therefore, in sum, it is to be realized that the optimum dimensional relationships for the parts of the invention to include variations in size, materials, shape, form, function and use are deemed readily apparent and obvious to the skilled artisan, and all equivalent relationships to those illustrated in the drawings and described in the specification are intended to be encompassed by the present invention.

Thus the foregoing is considered as illustrative only of the principles of the invention. Further, since numerous modifications and changes will readily be apparent to those having ordinary skill in the art, it is not desired to limit the invention to the exact construction demonstrated. Accordingly, all suitable modifications and equivalents may be resorted to falling within the scope of the invention. Unless defined otherwise, all technical and scientific terms used herein have same meaning as commonly understood by one of ordinary skill in the art to which this invention belongs.

As used herein and in the appended claims, the singular form "a", "and", and "the" include plural referents unless the context clearly dictates otherwise. All technical and scientific terms used herein have the same meaning.

The publications discussed herein are provided solely for their disclosure prior to the filing date of the present application. All publications, patent applications, patents are incorporated by reference in their entirety. Nothing herein is to be construed as an admission that the present invention is not entitled to be of patentable nature.

What is claimed is:

1. A container comprising:

a tray comprising a base bottom portion and one or more sidewalls having a volume for holding a product;

a lid that has a flat lower surface and that is attachable to the tray to protect the product in the tray when attached thereto;

air flow openings provided above the sidewall(s) of the tray and below the lid when the lid is attached to the tray to allow air flow into the container; and a divider for providing a plurality of compartments with a predetermined volume in the tray, the divider configured, dimensioned and positioned to include:

(a) a central section to support the lid, wherein the central section of the divider has an elongated surface that represents about ¼ to ½ of the overall length of the divider, wherein the upper surface contacts and supports the lid when the lid is closed over the compartment;

(b) shoulder portions adjacent the central section that are spaced from and do not contact the lid when the lid is closed over the compartments to allow air flow between the compartments and over the divider; and (c) arcuate end portions extending downwardly from the shoulder portions and connected to the sidewall(s) to provide torsional rigidity to the tray.

2. The container of claim 1 wherein the upper surface of the central section of the divider is flat to support the closed lid.

3. The container of claim 2 wherein the shoulder portions are horizontal, angled or inclined compared to the central section.

4. The container of claim 3 wherein the end portions are configured as first and second arcuate tray strengthening portions that are positioned below the upper surface of the shoulder portions and below the top of the sidewall(s) of the container.

5. The container of claim 4 wherein the divider comprises first and second walls joined by an upper portion in which the upper portion includes the central section, the first and second shoulders and the first and second arcuate tray strengthening portions.

6. The container of claim 1 wherein the container is a rectangular clamshell further comprising a spine which is pivotally hinged to the base bottom portion via the lid.

7. The container of claim 6 wherein the sidewalls are curved to prevent bruising of container contents.

8. The container of claim 6 wherein the container comprises a plurality of snap locking members for attaching the lid to the tray for retaining contents within the container.

9. The container of claim 1 wherein the container further comprises a plurality of air vents located near the periphery of the lid, the periphery of the base bottom, or both wherein the air vents also allow evaporation or draining of water or moisture present inside the container.

10. The container of claim 1 wherein the first and second shoulder portions each constitute about ¼ and ⅓ of the overall length of the divider.

11. The container of claim 1 wherein the end portions each constitute about 1/25 to 1/10 of the overall length of the divider.

12. The container of claim 1 wherein the lid includes a recess configured and dimensioned to receive the base bottom of another container to allow stacking of one closed container upon another.

13. The container of claim 1 further comprising a soaking pad in each compartment to absorb moisture from container contents.

14. The container of claim 1 which is made of molded plastic.

15. The container of claim 1 comprising polyethylene terephthalate.

16. A container comprising:

a tray comprising a base bottom portion and one or more sidewalls having a volume for holding a product;

a lid that is attachable to the tray to protect the product in the tray when attached thereto; and a divider for providing a plurality of compartments with a predetermined volume in the tray, the divider configured, dimensioned and positioned to include;

(a) a central section to support the lid;

(b) shoulder portions adjacent the central section that allow air flow between the compartments over the divider; and (c) end portions adjacent the shoulder portions and connected to the sidewall(s) to provide torsional rigidity to the tray, wherein each compartment includes a plurality of air vents in a lower portion of the sidewall(s) and indentations extending into the compartment between adjacent air vents to minimize contact of container contents with the air vents.

17. A container comprising:

a tray comprising a base bottom portion and one or more sidewalls having a volume for holding a product;

a lid that is attachable to the tray to protect the product in the tray when attached thereto; and a divider for providing a plurality of compartments with a predetermined volume in the tray, the divider configured, dimensioned and positioned to include:

(a) a central section to support the lid, wherein the central section of the divider has an elongated surface that represents about 1/4 to 1/2 of the length of the divider, wherein the upper surface contacts and supports the lid when the lid is closed over the compartments;

(b) shoulder portions adjacent the central section that are spaced from and do not contact the lid when the lid is closed over the compartments to allow air flow between the compartments and over the divider; and (c) arcuate end portions extending downwardly from the shoulder portions and connected to the sidewall(s) to provide torsional rigidity to the tray;

wherein each compartment includes a plurality of air vents in a lower portion of the sidewall(s) and indentations extending into the compartment between adjacent air vents to minimize contact of container contents with the air vents.

* * * * *